US005580036A

United States Patent [19]

Browning

[11] Patent Number: 5,580,036

[45] Date of Patent: Dec. 3, 1996

[54] METHOD AND APPARATUS FOR REMOTELY SECURING AND SPACING TRUSSES AND OTHER BUILDING FRAME ASSEMBLIES

[76] Inventor: Douglas A. Browning, P.O. Box 249, Sykesville, Md. 21794

[21] Appl. No.: 407,326

[22] Filed: Mar. 20, 1995

[51] Int. Cl.[6] ..... B25B 1/20

[52] U.S. Cl. ..... 269/37; 269/904; 269/910

[58] Field of Search ..... 33/613, 696–698, 33/501; 269/93, 95, 904, 910, 152, 37, 75

[56] References Cited

U.S. PATENT DOCUMENTS

| | | | |
|---|---|---|---|
| 688,230 | 12/1901 | Isgrig et al. | 269/45 |
| 2,116,263 | 5/1938 | Harbaugh | 269/45 |
| 2,806,495 | 9/1957 | Merkle et al. | 269/45 |
| 3,172,507 | 3/1965 | Blyveis . | |
| 3,959,945 | 6/1976 | Allen . | |
| 4,234,174 | 11/1980 | Cardono | 269/37 |
| 4,253,649 | 3/1981 | Hewson . | |
| 4,322,064 | 3/1982 | Jarvis . | |
| 4,340,100 | 7/1982 | Anderson | 33/613 |
| 4,420,291 | 12/1983 | Hardin . | |
| 4,606,110 | 8/1986 | Goserud . | |
| 4,704,829 | 11/1987 | Baumker, Jr. . | |
| 4,958,814 | 9/1990 | Johnson . | |
| 5,148,890 | 9/1992 | Sipe . | |
| 5,161,345 | 11/1992 | Sobjack, Sr. . | |
| 5,163,233 | 11/1992 | Benson | 33/613 |
| 5,407,182 | 4/1995 | Hartley | 269/904 |

*Primary Examiner*—Robert C. Watson
*Attorney, Agent, or Firm*—Weil, Gotshal & Manges LLP

[57] ABSTRACT

An apparatus for safely and remotely securing in place and spacing building members such as roof trusses or gables. The apparatus is primarily comprised of a spacer having a first truss connector and a second truss connector. A pull-down arrangement is used to remotely engage the apparatus with a truss. In use, the apparatus is attached to a first building member which is then positioned with the apparatus attached. The apparatus is then remotely secured to a second, adjacent building member. A gable brace is provided that may be used alone or with an attached truss connector.

10 Claims, 5 Drawing Sheets

METHOD AND APPARATUS FOR REMOTELY SECURING AND SPACING TRUSSES AND OTHER BUILDING FRAME ASSEMBLIES

BACKGROUND OF THE INVENTION

This invention relates generally to a method and apparatus for installing roof trusses, gables, walls, or similar subassemblies in houses or other buildings under construction that enhances the safety and efficiency of workers.

Typically, during the construction of a house or other building, the walls are first built or installed. Next, gables and roof trusses are secured to the tops of the walls to support the sheathing of the roof and to provide the building with structural integrity. Where snow loads are a possibility, roof sheathing usually takes the form of sized sheets of plywood (or other material) which are nailed to the trusses to form the roofing surface to which shingles, rain gutters, and other devices are attached. When snow loads are not a concern, lathing strips are sometimes used instead of sheathing. The weight of this roofing material and the expected snow loads requires a supporting structure, which is the primary function of the roof trusses.

In the past, workers have typically spaced and secured roof trusses during construction by temporarily nailing 1"×3" boards (or similar support members) across adjacent trusses while standing atop or among the trusses being installed. This practice presents at least two major disadvantages. First, because the footing on the trusses is not solid, workers can easily fall from the trusses and suffer severe injury.

Second, as the sheathing is laid over and nailed to the trusses, the temporary support members must be successively removed to enable the sheathing to be nailed to the trusses flush with those sheathing sections that have already been nailed down. Much time and effort is required to remove these temporary supports. Further, the boards are usually damaged during removal to such an extent that they must be discarded.

SUMMARY OF THE INVENTION

In accordance with the present invention, applicant provides a spacing tool useful in the erection of roof trusses and other structural building elements. The tool comprises a spacer bar of either a fixed or an adjustable length having a fixed end and a swing end. The spacing member is attached proximate the fixed end via a spring-loaded hinge to a first connector intended for attachment to a roof truss. A second connector is attached to the spacing member proximate the swing end which is swung into engagement with an adjacent truss when the trusses are properly positioned with respect to one another during installation. The spacing tool of the invention thereby supports adjacent trusses in a properly spaced relationship. A pull-down arrangement is provided that permits a worker to operate the tool from below.

In a preferred embodiment, the connectors are each generally U-shaped in cross section. One leg of the first connector preferably includes a latching member for securely latching onto the chord of a truss to which the connector is being attached. One leg of the second connector preferably includes a tab or latch extending into the interior of the U for latching onto an adjacent truss under control of the pull-down arrangement during construction.

In operation, the first connector is attached to a first roof truss, normally while the truss is still on the ground. After the truss with the attached device is appropriately positioned atop the building under construction, a worker on the floor below can use the pull-down arrangement to engage the second connector with an adjacent truss, thereby securing both trusses in place. The truss with which the second connector is engaged can be a previously installed truss or the next-installed truss.

Optionally, the spacing tool of the invention can include a gable brace in lieu of a first connector. A gable brace comprises a gable clamp and a board socket connected to the gable clamp via a universal joint. In operation, the gable clamp is attached to a roof gable, and an end of a board, typically a 2"×4", is affixed in the socket before the gable is lifted into place. After the gable with the attached tool is appropriately positioned atop the wall, the free end of the board is secured to a stable anchoring point, thereby securely positioning the gable atop the wall. The second connector of the spacing tool can then be attached under control of the pull-down arrangement to the adjacent truss.

In accordance with another aspect of the invention, the gable brace may be constructed without the remainder of the spacing tool and used for securing a gable in a proper vertical position atop a wail.

BRIEF DESCRIPTION OF THE DRAWINGS

The advantages and features of this invention will become apparent from the following specification in conjunction with the drawings, in which.

DETAILED DESCRIPTION OF THE INVENTION

Figure 1:
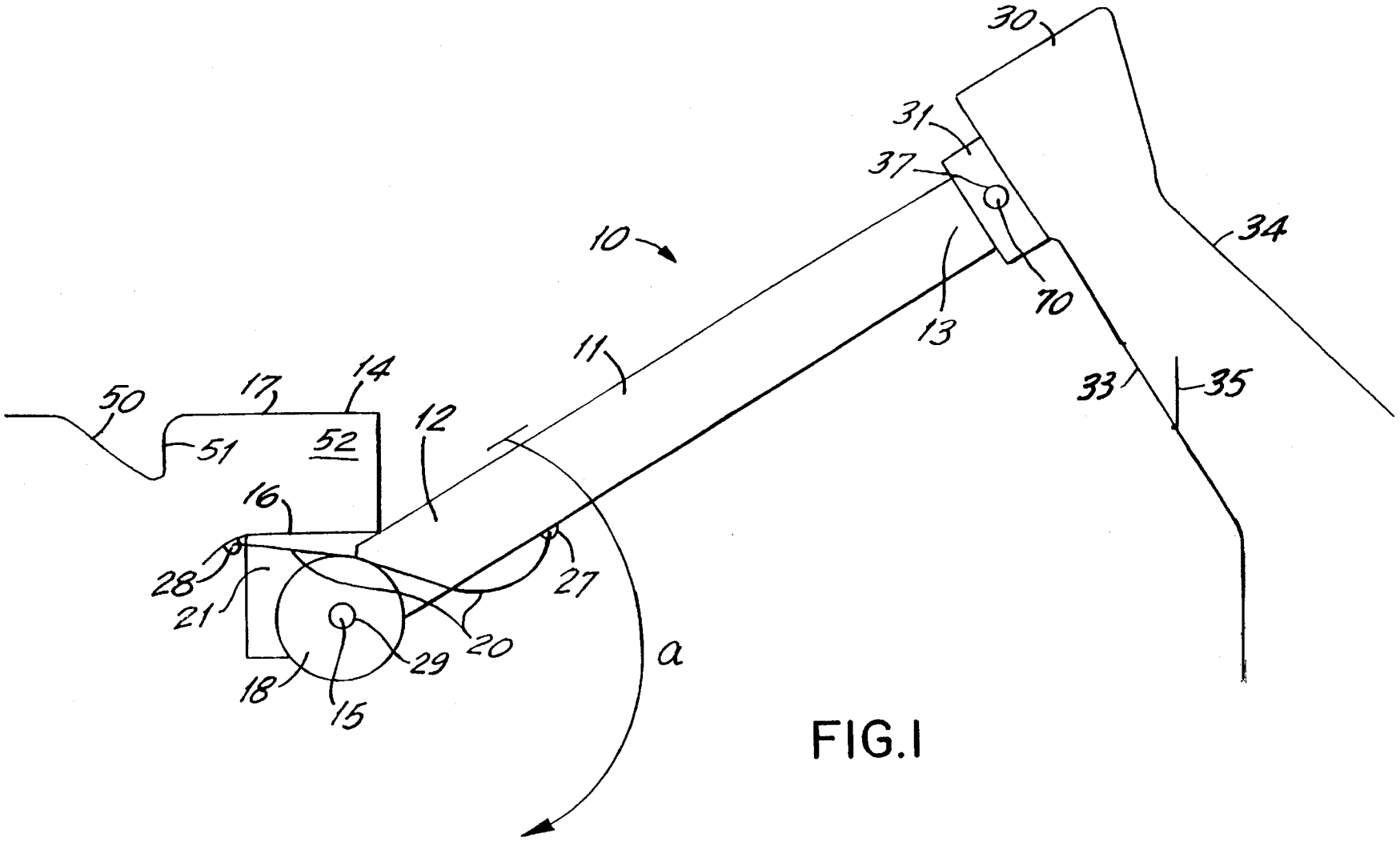
FIG. 1 is a side view of a preferred embodiment of a spacing tool in accordance with this invention.

Referring to FIG. 1 of the drawings, the illustrated embodiment of the spacing tool 10 of the invention includes a spacing bar or member 11 having a fixed end 12 and a swing end 13. The bar 11 may be of fixed or variable length. A variable length bar may use threaded tubes, telescoping tubes, slotted bars, or other suitable arrangement for adjusting the length of the bar as desired. The illustrated bar 11 is a metal tube having an approximately 1" square cross section.

Figure 2:
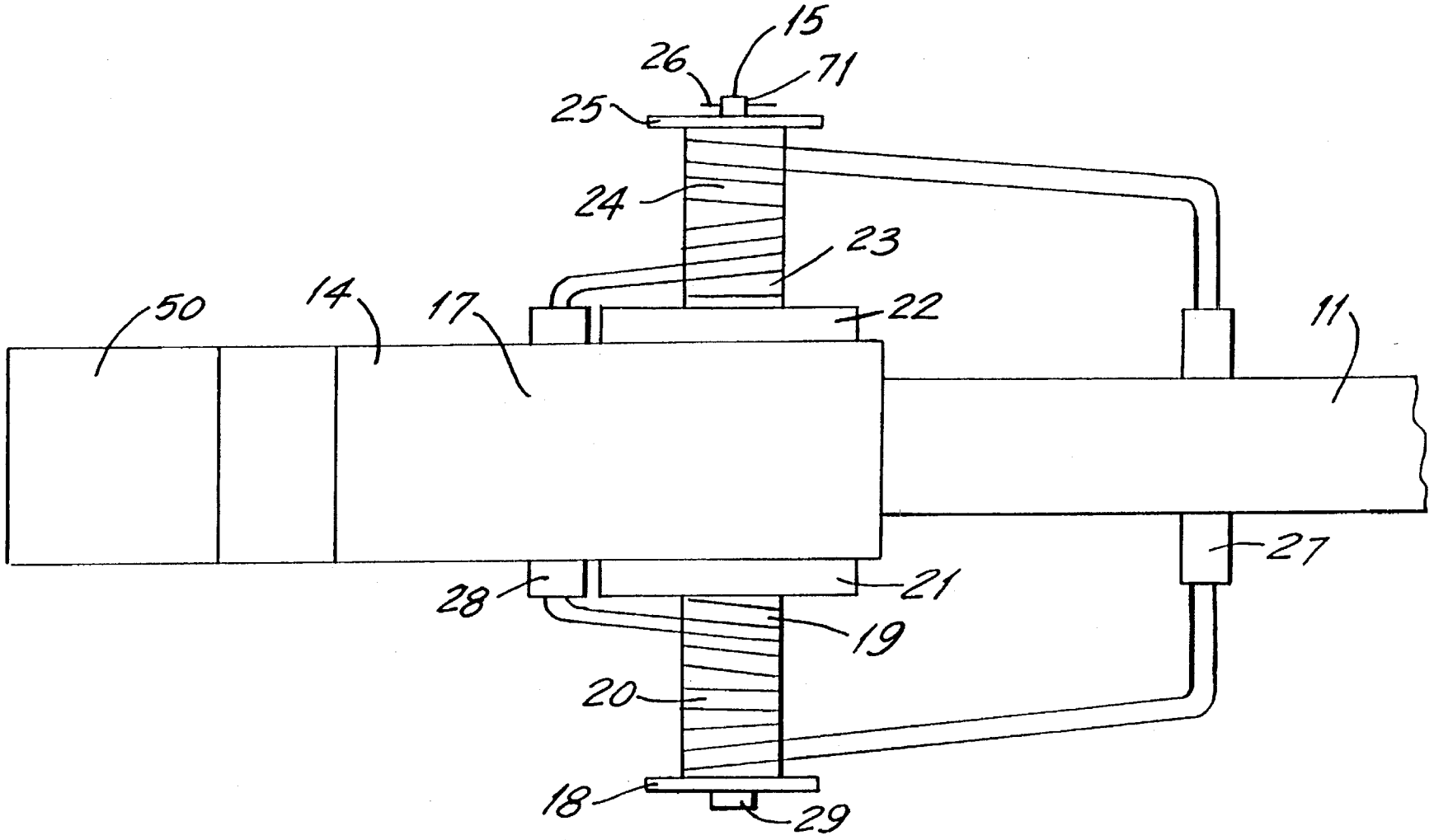
FIG. 2 is a top view of the fixed end of the spacing tool of FIG. 1.

A first connector 14 is pivotally attached to the fixed end 12 of the bar 11. In the illustrated embodiment, the first connector 14 is formed of ⅛" thick spring steel, is generally U-shaped in cross section, and includes a proximal leg 16 adjacent to the bar 11 and a distal leg 17. Referring to FIGS. 1 and 2, parallel tabs 21 and 22 extend from each side of the proximal leg 16 perpendicular to the major surface thereof to form a mounting bracket for attaching the connector 14 to the bar 11.

The connection between the connector 14 and the fixed end 12 of the bar 11 is accomplished by means of a pin 15 passing through aligned holes in the tabs 21 and 22 and the bar 11 and through bushings 19 and 23 positioned on either side of the bar 11 exterior to the tabs 21 and 22. An enlarged head 29 on one end of pin 15 and a cotter pin 26 passing through a hole 71 on the other end of pin 15 hold the bar 11, the connector 14, the bushings 19 and 23 and the washers 18 and 25 together.

The outer end of the proximal leg 16 is bent outwardly to facilitate the installation of the connector over the chord of a roof truss. The distal leg 17 includes an integral extension 50 that is bent first inwardly to form a latching shelf 51 and then outwardly form a handle to facilitate the mounting and removal of the connector 14 to and from a truss. With the latching shelf 51, the connector 14 defines a generally rectangular interior space 52 sized to accept the roof truss chord over which the connector 14 is to be installed. Alternatively, the connector 14 could be attached to the truss chord by nails driven through holes optionally provided in one of the legs of the connector 14.

Referring to FIGS. 1 and 2, two double torsion springs 20 and 24 are mounted on the bushings 19 and 23, respectively, in compression against the lower faces of the proximal leg 16 and the bar 11 (as seen in FIG. 1) for biasing the bar 11 toward an upright position when the connector 14 is mounted on a truss cord. Thus the springs 20 and 24 bias the bar 11 relative to the first connector 14 in the direction opposite to that indicated by arc a. The corresponding ends of the double torsion springs 20 and 24 are connected by rigid metal tubes 27 and 28. Washers 18 and 25 are used to prevent the springs 20 and 24 from sliding off the bushings 19 and 23.

Substantially any resilient member, such as a leaf spring or a member fabricated of rubber or other elastomeric material, which tends to upwardly bias the bar 11 may be used in place of the springs 20 and 24. All references herein to the springs 20 and 24 are intended to include all such types of resilient members. As an alternative to using the springs 20 and 24 or other resilient member, it is possible to make the bar 11 resilient, so long as the bar has adequate strength and stiffness when the swing end 13 is brought into engagement with an adjacent truss. In such a case, the bar 11 would be rigidly attached to the first connector 14.

Figure 3:
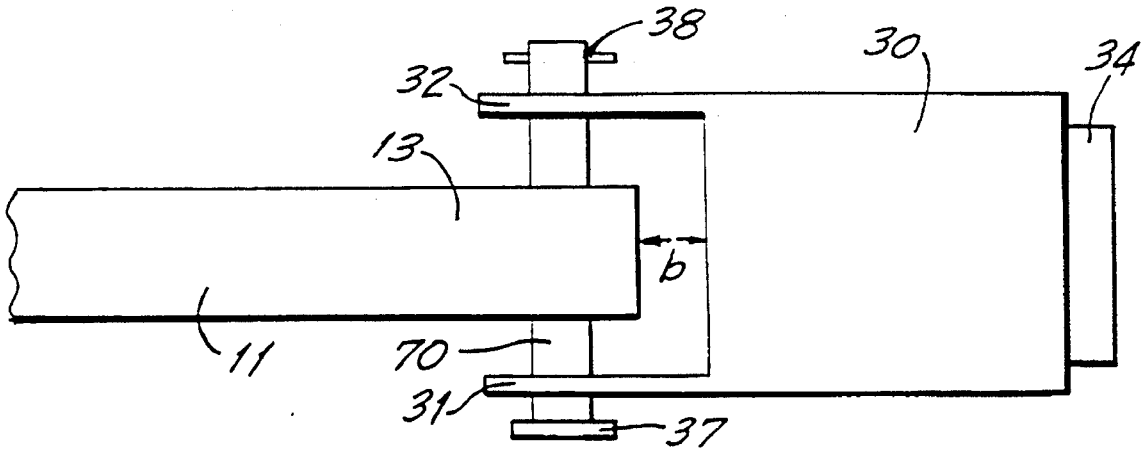
FIG. 3 is a top view of the swing end of the spacing tool of FIG. 1.

Referring to FIGS. 1 and 3, the swing end 13 of the bar 11 is pivotally attached to a second connector 30. The second connector 30 has a generally U-shaped cross section and includes a proximal leg 33 adjacent to the bar 11 and a distal leg 34. Both the proximal and distal legs 33 and 34 are flared outward for guiding a chord of a truss into the connector 30. A pair of parallel tabs, 31 and 32, extend perpendicular to the major surface of the proximal leg 33 to form a mounting bracket for attaching the connector 30 to the swing end 13 of the bar 11. The connector 30 is pivotally attached to the swing end 13 of bar 11 by a pin 70 passing through aligned holes in tabs 30 and 31 and the bar 11. An enlarged head 37 on one end of pin 70 and a cotter pin 38 passing through a hole on the other end of pin 37 hold the assembly together. The distance b between the end of the bar 11 and the proximal leg 33 is such that the end of the bar 11 limits the pivotal motion of the connector 30 to an arc of about 15° around the position in which the mouth of the U opens orthogonally to the major dimension of the bar 11.

Figure 4:
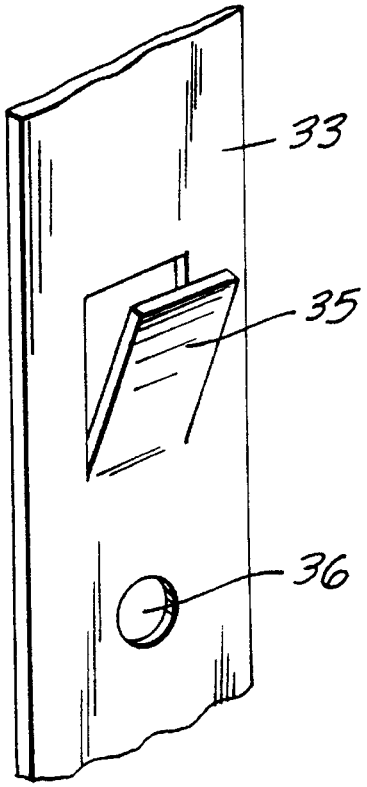
FIG. 4 is an isometric view showing a detail of the swing end connector latch of FIG. 1.

Referring to FIG. 4, a hole 36 and a tab 35 are formed of the proximal leg 33 of the connector 30. The tab 35 is positioned on the proximal leg 33 such that the distance between the extending top of the tab 35 and the interior surface of the top of the connector 30 (as seen in FIG. 1) is slightly larger than the corresponding dimension of the truss chord to which the connector 30 is to be attached.

In operation, the spacing tool 10 of the invention is attached to a top chord of a truss with the bar 11 extending upwardly from the chord before the truss is lifted into place atop the wails. A rope is attached to the swing end connector 30 of the spacing tool through the hole 36 as a pull-down arrangement. The truss, with the tool attached, is then lifted with a crane to a position atop the wails, parallel to and a predetermined distance from the position of an adjacent truss. The second connector 30 on the swing end 13 of the tool 10 is brought into engagement with the top chord of the adjacent truss by pulling on the rope from below.

As the rope is pulled, the bar 11 swings against the bias of the springs 20 and 24 until the swing end connector 30 engages the adjacent truss. The connector 30 is preferably formed of spring steel and flexes sufficiently to permit the tab 35 to ride over and pass the truss chord, thereby trapping the chord in the connector 30. The small amount of pivoting action of the connector 30 with respect to the bar 11 facilitates the engagement of the connector 30 with the truss chord.

The use of the tool 10 of the invention in the erection of each truss results in ail of the trusses being secured to each other in a substantially rigid structure before the roof sheathing is applied. The tools of this invention may be removed from the trusses as the roof sheathing is applied, since the sheathing itself supplies the needed structural support for the trusses. The extended legs of the connectors 14 and 30 allow the connectors to be easily manually unlatched from the truss chords for removal of the tool. Alternatively, if desired, the tools may be left in place without adversely affecting the sheathing operation.

Figure 5:
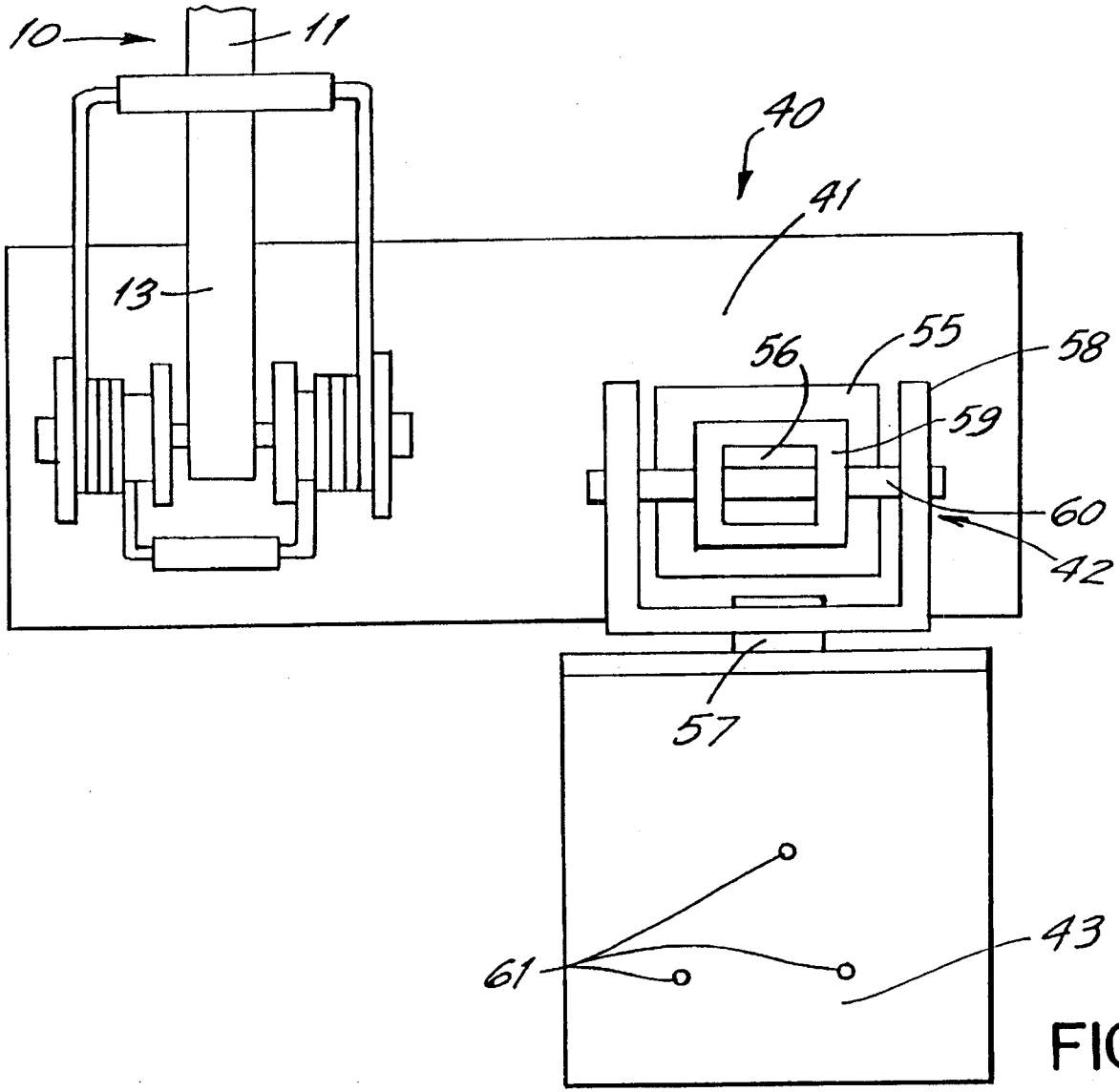
FIG. 5 is a front view of a preferred embodiment of a gable brace with an attached spacing tool.
Figure 6:
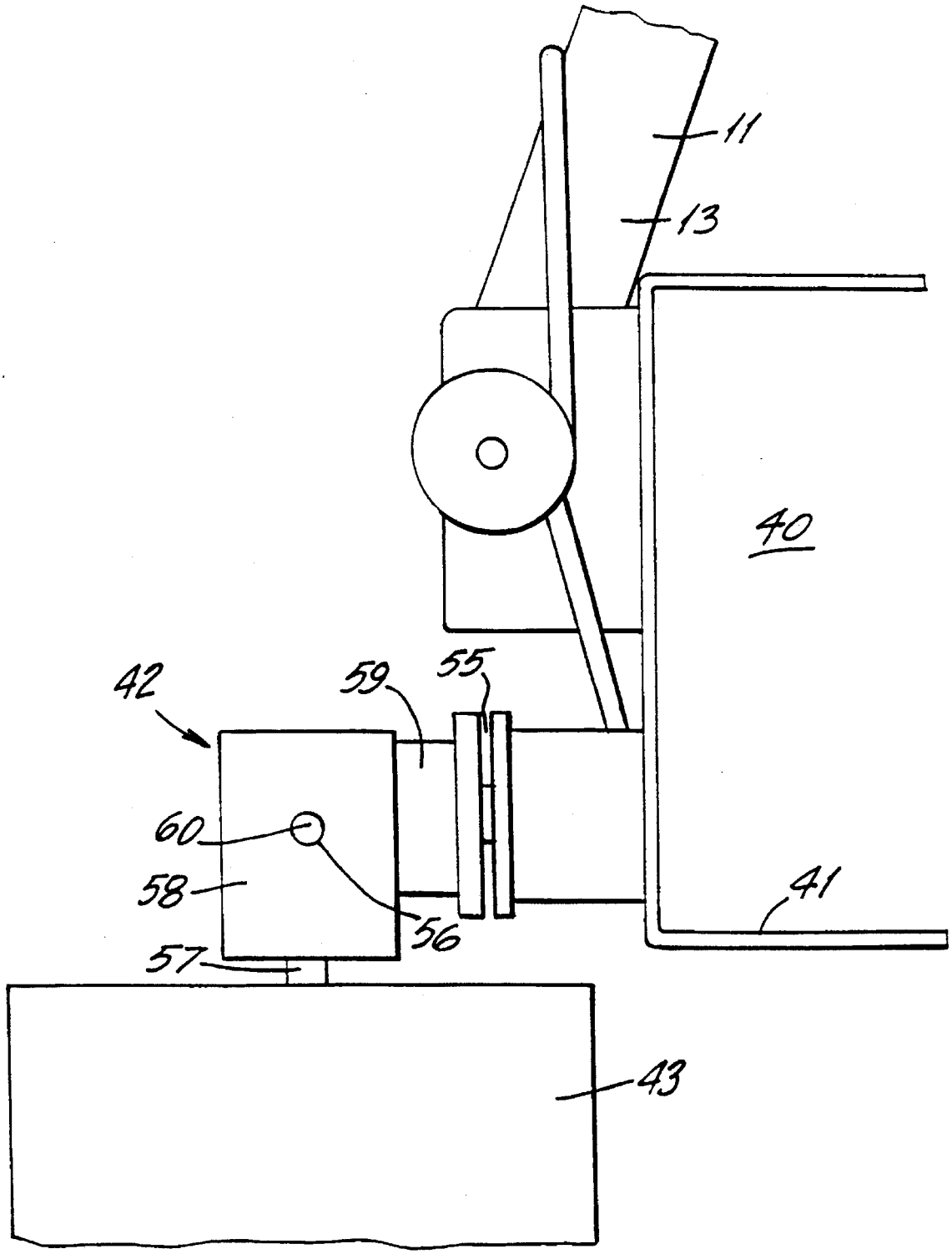
FIG. 6 is a side view of the gable brace of FIG. 5.

Optionally, as illustrated in FIGS. 5 and 6, the fixed end 13 of the bar 11 may be attached to a gable brace 40 rather than to a first truss connector. A gable brace 40 is used to hold a roof gable in place on a building while the building is under construction and is typically removed thereafter. The illustrated embodiment of the gable brace 40 comprises a gable clamp 41 attached via a universal joint 42 to a board socket 43. The bar 11 of the spacing tool 10 is pivotally attached via a double torsion spring subassembly (essentially the same as that described above in connection with FIGS. 1 and 2) to the gable clamp 41 rather than to a first truss connector. The spring subassembly biases the bar 11 to an upward position when the gable brace 40 is installed on a gable.

In a preferred embodiment, the gable clamp 41 is formed of a steel U-shaped channel member sized to fit over a chord of a gable. The gable clamp 41 can be secured to a gable by driving nails through holes (not shown) in the opposing legs of the channel member.

The universal joint 42 in the illustrated embodiment of the invention is composed of a series-connected rotational joint 55, pivot joint 56, and rotational joint 57. The rotational joint 57 connects the universal joint 42 to the closed end of the socket 43. The illustrated pivot joint 56 is a U-shaped member 58 connected to a short bar 59 with a pin 60. Other types of universal joints, such as a ball-and-socket, may equally well be used, so long as they have sufficient strength.

In the illustrated embodiment, the board socket 43 comprises a rectangular metal socket sized to accept a board such as a 2"×4". A board is secured in the socket by driving nails through holes 61 in the sides of the socket.

In operation, the gable clamp 41 is fastened over a chord of a gable to be installed by nails driven through the holes in the sides of the gable clamp 41. Next, a board of adequate length is secured in the board socket 43. The gable, with the attached brace 40, is raised, usually by means of a crane, into position for installation. The free end of the board is then nailed to a secure anchoring point in the structure, thereby securing the gable in position atop the building. The spacing tool, if provided, may then be remotely attached, as described above, to the adjacent truss.

Although I have disclosed the preferred embodiment of my invention, changes and modifications in the specifically described embodiments can be carried out without departing from the principles of the invention, which is intended to be limited only by the scope of the appended claims. For instance, the positions of the latching members and extended portions of the connectors 14 and 33 could be moved to the opposite legs and other pull-down arrangements such as a latch for receiving a hooked pole or other pull-down member could replace the hole 36. Additionally, although the illustrated embodiments of the tool of the invention have been discussed in relation to the positioning and supporting of roof trusses and gables, it should be apparent that such tools, sometimes with minor modifications, could be used to position and support other building subassemblies, such as walls.

I claim:

1. A spacing tool for positioning and supporting a first subassembly of a building in properly spaced relationship with an adjacent second subassembly comprising a spacing bar having a fixed end and a swing end;

a first connector pivotally connected to the fixed end of said spacing bar for connecting the tool to a segment of said first subassembly;

a spring for resiliently biasing said bar in a first direction in relation to said first connector; and a second connector attached to the swing end of said spacing bar for latching to a segment of said second subassembly when said first and second subassemblies are properly positioned with respect to one another and said spacing bar is pivoted against bias into engagement with said second subassembly under the control of pull-down means attached to the tool.

2. The spacing tool of claim 1 wherein said first connector comprises a generally U-shaped clamp sized to fit over a segment of said first subassembly.

3. The spacing tool of claim 2 wherein said clamp further comprises means for latching said first subassembly into said clamp.

4. The spacing tool of claim 3 wherein said latching means comprises a shelf formed in a leg of said clamp.

5. The spacing tool of claim 1 wherein said second connector comprises a generally U-shaped clamp sized to fit over a segment of said second subassembly.

6. The spacing tool of claim 5 wherein said second connector further comprises means for latching said second subassembly into said clamp.

7. The spacing tool of claim 6 wherein said latching means comprises a tab extending from the interior wall of said clamp into the interior of said clamp.

8. The spacing tool of claim 1 wherein said spring comprises one or more double torsion springs.

9. The spacing tool of claim 1 wherein said first connector is a gable brace comprising a gable connector for connecting the gable brace to a segment of a roof gable;

a board socket for connecting the gable brace to a board; and a universal joint for connecting said gable connector to said board socket.

10. The spacing tool of claim 9 wherein said gable brace comprises a generally U-shaped channel member.

* * * * *